US006616464B1

(12) United States Patent
Tosaka

(10) Patent No.: US 6,616,464 B1
(45) Date of Patent: Sep. 9, 2003

(54) ROBOT DEVICE

(75) Inventor: Susumu Tosaka, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/743,234

(22) PCT Filed: May 10, 2000

(86) PCT No.: PCT/JP00/02983

§ 371 (c)(1),
(2), (4) Date: Mar. 6, 2001

(87) PCT Pub. No.: WO00/67962

PCT Pub. Date: Nov. 16, 2000

(30) Foreign Application Priority Data

May 10, 1999 (JP) ..... 11-129206

(51) Int. Cl.[7] ..... H01R 4/66
(52) U.S. Cl. ..... 439/101; 439/924.1; 901/1
(58) Field of Search ..... 439/101, 108, 439/924.1; 901/1

(56) References Cited

U.S. PATENT DOCUMENTS 6,509,707 B2 * 1/2002 Yamashita et al.
6,381,515 B1 * 4/2002 Inoue et al.
6,421,585 B1 * 7/2002 Takamura
6,439,951 B1 * 8/2002 Kawakita
6,458,011 B1 * 10/2002 Inoue et al.
6,484,068 B1 * 11/2002 Yamamoto et al.
6,493,606 B2 * 12/2002 Saijo et al.
6,512,965 B2 * 1/2003 Osawa
6,519,506 B2 * 2/2003 Osawa
6,538,410 B2 * 3/2003 Mori et al.
6,539,283 B2 * 3/2003 Takagi

FOREIGN PATENT DOCUMENTS

| | | |
|---|---|---|
| JP | 4-102587 | 4/1992 |
| JP | 10-50428 | 2/1998 |
| JP | 11-58272 | 3/1999 |

* cited by examiner

*Primary Examiner*—Gary Paumen
(74) *Attorney, Agent, or Firm*—Frommer Lawrence & Haug LLP; William S. Frommer

(57) ABSTRACT

An entertainment robot whose modules such as paws, hind legs and head can be replaced without the power off. Specifically, of the ten pins of the OPEN-R connector 500, the DGND and PWRGND ones are formed longer than the other.

3 Claims, 9 Drawing Sheets

$R_1 = 1.5k\Omega$
$R_2 = 15k\Omega$

ROBOT DEVICE

TECHNICAL FIELD

The present invention relates to a robot apparatus for entertainment, and specifically, to a robot apparatus whose modules such as paws, hind legs and head can be replaced without the power off.

BACKGROUND ART

As entertainment robots, there have been proposed walking robots designed in the form of quadruped animals with paws and hind legs such as dogs or cats. Such a robot has actuators having a predetermined degree of freedom, mechanisms having displaced in place therein sensors to detect specific physical values and a controller using a microcomputer. When an external command is given to the robot, the controller controls the actuators and mechanisms to work correspondingly.

Such a robot consists of modules including a head, main body, paws, hind legs, etc. Any of these modules can be replaced when it is found defective.

When replacing any of these modules, the conventional robot must be deenergized. However, once it is thus deenergized, data on its current state and also what it has learned so far will unavoidably be lost. Thus, when the power is recovered, it is necessary to have the robot learn from the beginning.

Furthermore, once the power is turned off, the conventional robot has to start from its initialization when the power is recovered, which will take a long time.

DISCLOSURE OF THE INVENTION

Accordingly, the present invention has an object to overcome the above-mentioned drawbacks of the prior art by providing a robot apparatus whose modules such as paws, hind legs and head can be replaced without the power off.

The above-object can be attained by providing a robot apparatus including:

one or more driving units; and a main body for controlling the driving units;

each of the driving units being connected to the main body by a connector having ground, power and data lines in such a manner that the ground line will be disconnected later than the power and data lines when any of the driving units is dismounted from the main body and that it will be connected earlier than the power and data lines when the driving unit is mounted in place again.

With the robot apparatus according to the present invention, the ground line is connected earliest when any of the driving units is mounted to the main body and it is disconnected last when the driving unit is dismounted from the main body. Thus, the robot apparatus is prevented from being troubled circuits in the main body and driving units when replacing any of its modules.

BEST MODE FOR CARRYING OUT THE INVENTION

The best modes for carrying out the present invention will be described below with reference to the accompanying drawings.

Figure 1:
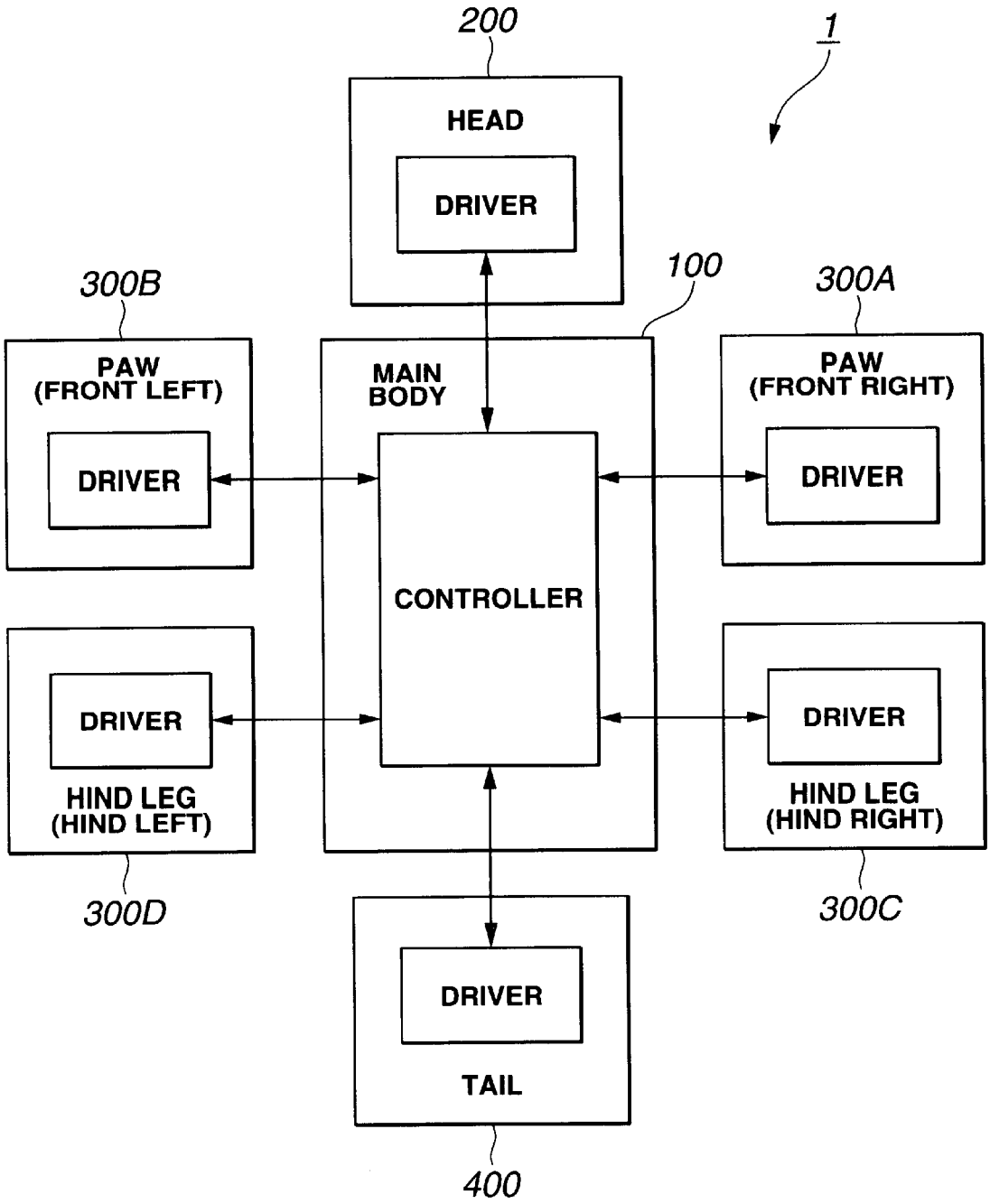
FIG. 1 is a block diagram of the robot apparatus according to the present invention.
Figure 2:
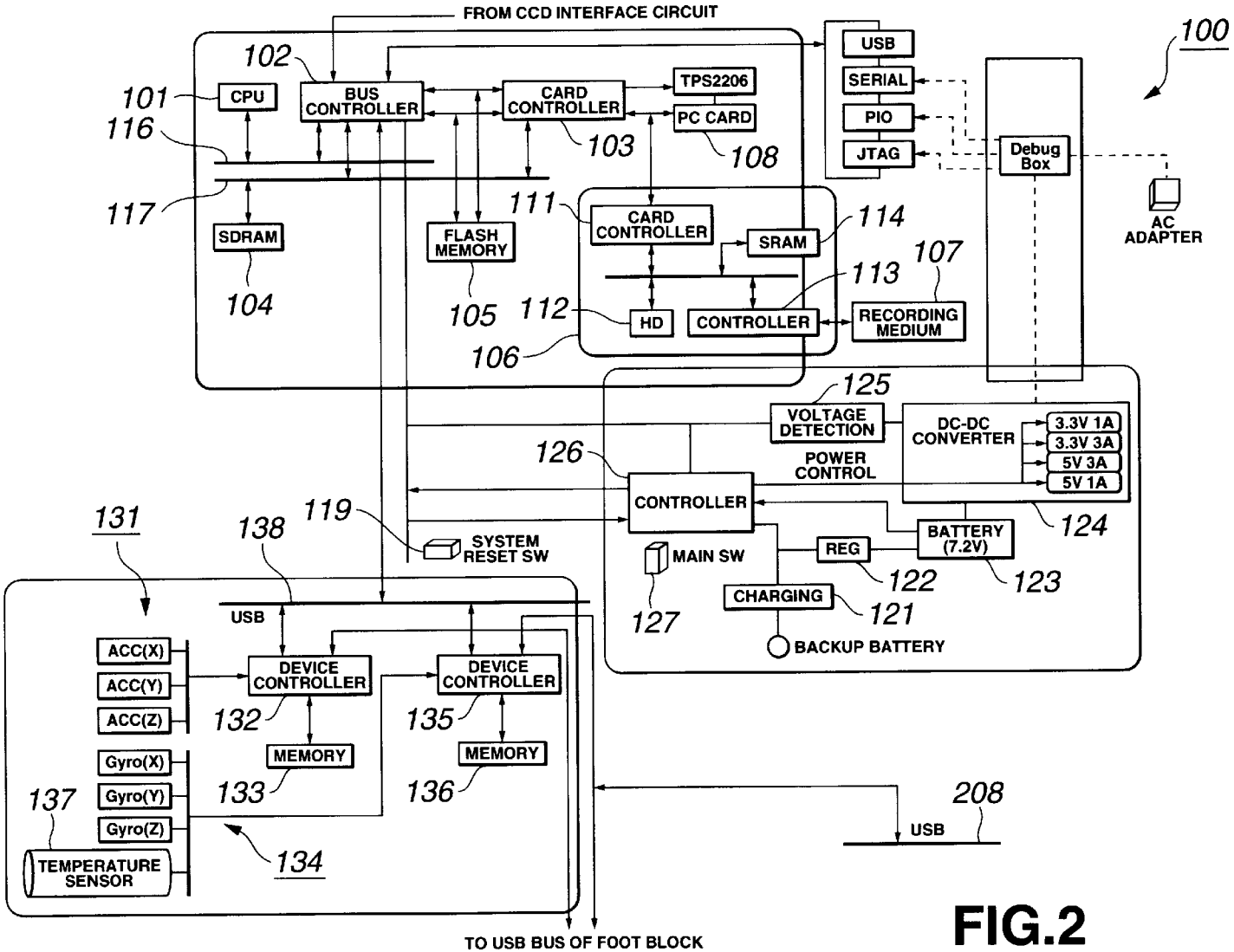
FIG. 2 is a block diagram of a body block of the robot.

The present invention is applicable to an entertainment robot shown in FIG. 1. The robot is generally indicated with a reference number 1. The robot 1 is a quadruped type robot designed to have the form of an animal with paws and hind legs such as a dog or cat. The robot 1 includes a body block 100, a head block 200, foot blocks 300 (300A, 300B, 300C, 300D), and a tail block 400, which correspond to a main body, head, paws and hind legs and a tail, respectively, of an animal. The foot blocks 300A, 300B, 300C and 300D correspond to a right paw, left paw, right hind leg and left hind leg, respectively, and they are of the same configuration.

The system to which the present invention is applied may be freely configured as long as the present invention can be applied. In the robot 1 which will be described below, however, the present invention is applied to a robot configured according to the OPEN-R (trade mark) specification oriented for the entertainment robots provided by the SONY corporation. The OPEN-R will be outlined below.

According to the OPEN-R specification, the configuration of a robot can be changed freely. This can be attained by connecting various devices to the ends of the OPEN-R bus which is a serial bus. Also, mounting and dismounting of hard modules of a robot can be supported by managing the configuration information at a host side.

The advantage assured by employing such a serial bus for access to each device in the robot is that the wiring can be facilitated very much.

The present invention will be described below concerning the robot 1 including the above system designed based on the OPEN-R specification.

The body block 100 of the robot 1 includes a CPU 101 to control the whole system of the robot 1, an OPEN-R bus controller 102 to process data and control memories, a PC card controller 103, an SDRAM 104 to temporarily store data, a flash memory 105 to store initial state data of each circuit, a removable stick-shaped recording medium 107 to read/write data via an interface circuit 106, and a PC card 108.

The CPU 101 controls the OPEN-R bus controller 102 via a bus 116. The OPEN-R bus controller 102 is connected to the PC card controller 103, bus 116, 117 and head block 200. The OPEN-R bus controller 102 controls each circuit in such a manner that the whole system of the robot 1 is reset when a system reset switch 119 is turned on. Also, the OPEN-R bus controller 102 filters image data from the head block 200 and works as a master or host of the system. The present system is referred hereinafter to as an "OPEN-R bus system".

The OPEN-R bus controller 102 directly reads/writes data from/to the flash memory 105, and controls reading/writing of data from/to the SDRAM 104 via the bus 117. Also, the OPEN-R bus controller 102 reads/writes data from/to the PC card 108 via the PC card controller 103, and controls reading/writing of data from/to the stick-shaped recording medium 107 via the PC card controller 103 and interface circuit 106.

The interface circuit 106 includes a card controller 111 to send/receive data to/from the PC card controller 103, a hard disc (HD) 112 to accumulate data, a stick-shaped recording medium controller 113 to directly read/write data from/to the stick-shaped recording medium 107, and an SRAM 114.

The body block 100 further includes a charging circuit 121 from an external power supply to charge a battery 123 which will further be mentioned below, a regulator 122 to maintain a voltage at a constant value, a 7.2-V battery 123, a DC-DC converter 124 to convert the voltage of the battery 123 to predetermined values, a voltage detector 125 to detect voltages converted at the DC-DC converter 124, and a controller 126 to control the voltage generation of the DC-DC converter 124.

The regulator 122 converts a voltage of 7.2 V from the battery 123 to a voltage of 3.3 V and applies the converted voltage to the controller 126. The DC-DC converter 124 converts the voltage of the battery 123 to generate DC powers of 3.3V-1A, 3.3V-3A, 5V-3A and 5V-1A and supplies the DC powers to each circuit of the whole apparatus. The voltage detector 125 detects these DC voltages and supplies the detection result to the controller 126 and OPEN-R bus controller 102. The controller 126 monitors the output of the voltage detector 125 to control the DC-DC converter 124 so that it can appropriately convert the voltage of the battery 123 to each of the predetermined values. The controller 126 controls the DC-DC converter 124 to generate each of the predetermined powers when a main switch 127 is turned on, and it terminates the generation of the voltages when the main switch 127 is turned off.

The body block 100 further includes an acceleration sensor 131, an OPEN-R device controller 132, memories 133, 136 to store initial state data and temporarily store predetermined data, a rotation angle sensor 134, an OPEN-R device controller 135, and a temperature sensor 137. The acceleration sensor 131 detects an acceleration of each of the X, Y and Z axes and supplies the detection result to the OPEN-R device controller 132. The OPEN-R device controller 132 stores the detection result into the memory 133 and supplies the detection result to the OPEN-R bus controller 102 via a bus 138. The rotation angle sensor 134 detects rotation angles of each of the X, Y and Z axes and supplies the detection result to the OPEN-R device controller 135. The temperature sensor 137 detects a present temperature and supplies the detection result to the OPEN-R device controller 135. The OPEN-R device controller 135 stores these detection results into the memory 136 and supplies the detection results to the OPEN-R bus controller 102 via the bus 138.

The head block 200 is configured as will be explained below.

Figure 3:
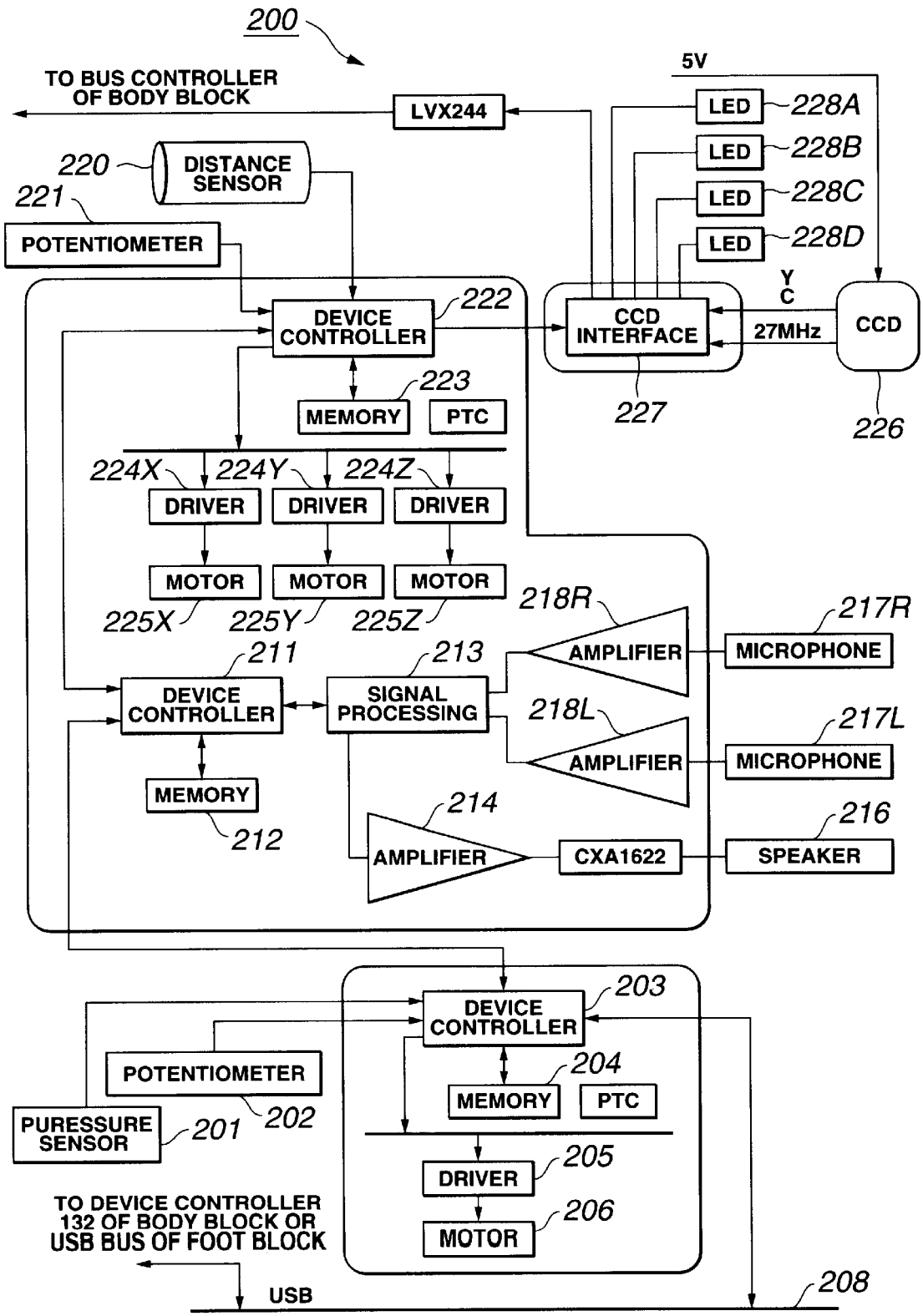
FIG. 3 is a block diagram of a head block of the robot.

As shown in FIG. 3, the head block 200 includes a pressure sensor 201 to detect external pressure, a potentiometer 202, an OPEN-R device controller 203 to control predetermined circuits, a memory 204 to store initial state data and temporarily store predetermined data, and a motor 206 driven by a driver 205.

The pressure sensor 201 detects an externally applied pressure, and supplies the detected pressure to the OPEN-R device controller 203. The OPEN-R device controller 203 is connected to the body block 100 via a bus 208, and perform a predetermined control in accordance with instructions from the body block 100. For example, the OPEN-R device controller 203 supplies the detection result of the pressure sensor 201 to the body block 100 via the bus 208, and controls the rotation of the motor 206 by means of the driver 205.

The head block 200 further includes an OPEN-R device controller 211, a memory 212 to temporarily store data which is which is to be used at the OPEN-R device controller 211, a signal processing circuit 213 to process a signal in a predetermined manner, a speaker 216 to output a speech based on speech data amplified by an amplifier 214, microphones 217 (217R, 217L), and amplifiers 218 (218R, 218L) to amplify speech data from the microphones 217 and supply the amplified speech data to the signal processing circuit 213.

The OPEN-R device controller 211 is connected to the OPEN-R device controller 203, signal processing circuit 213 and an OPEN-R device controller 222 which will further be mentioned below, and sends/receives a control signal and other signals to/from these circuits. The OPEN-R device controller 211 supplies speech data sent from the body block 100 via the OPEN-R device controller 203 to the signal processing circuit 213, and speech data from the signal processing circuit 213 to the OPEN-R device controller 222, for example.

The head block 200 further includes a distance sensor 220 to measure a distance from itself to an object, a potentiometer 221, an OPEN-R device controller 222 to control predetermined circuits, a memory 223 to store initial state data which is to be used at the OPEN-R device controller 222 and temporarily store predetermined data, and motors 225 (225X, 225Y, 225Z) driven by drivers 224 (224X, 224Y, 224Z) under the control of the OPEN-R device controller 222.

The head block 200 further includes a CCD image sensor 226 to generate image data, a CCD interface circuit 227 to process the image data in a predetermined manner, LEDs (light emitting diodes) 228 (228A, 228B, 228C, 228D) which emit light to express emotions, which would be with a living animal, of the robot 1. The CCD image sensor 226 corresponds to eyes of an animal, and generates image data consisting of luminance signals Y and chroma signals C based on reflected light of an object and supplies the image data to the CCD interface circuit 227. The CCD interface circuit 227 process the image data in a predetermined manner and supplies the processed image data to the OPEN-R bus controller 102 of the body block 100. The CCD interface circuit 227 also causes the LEDs 228 to emit light under the control of the OPEN-R device controller 222.

Figure 4:
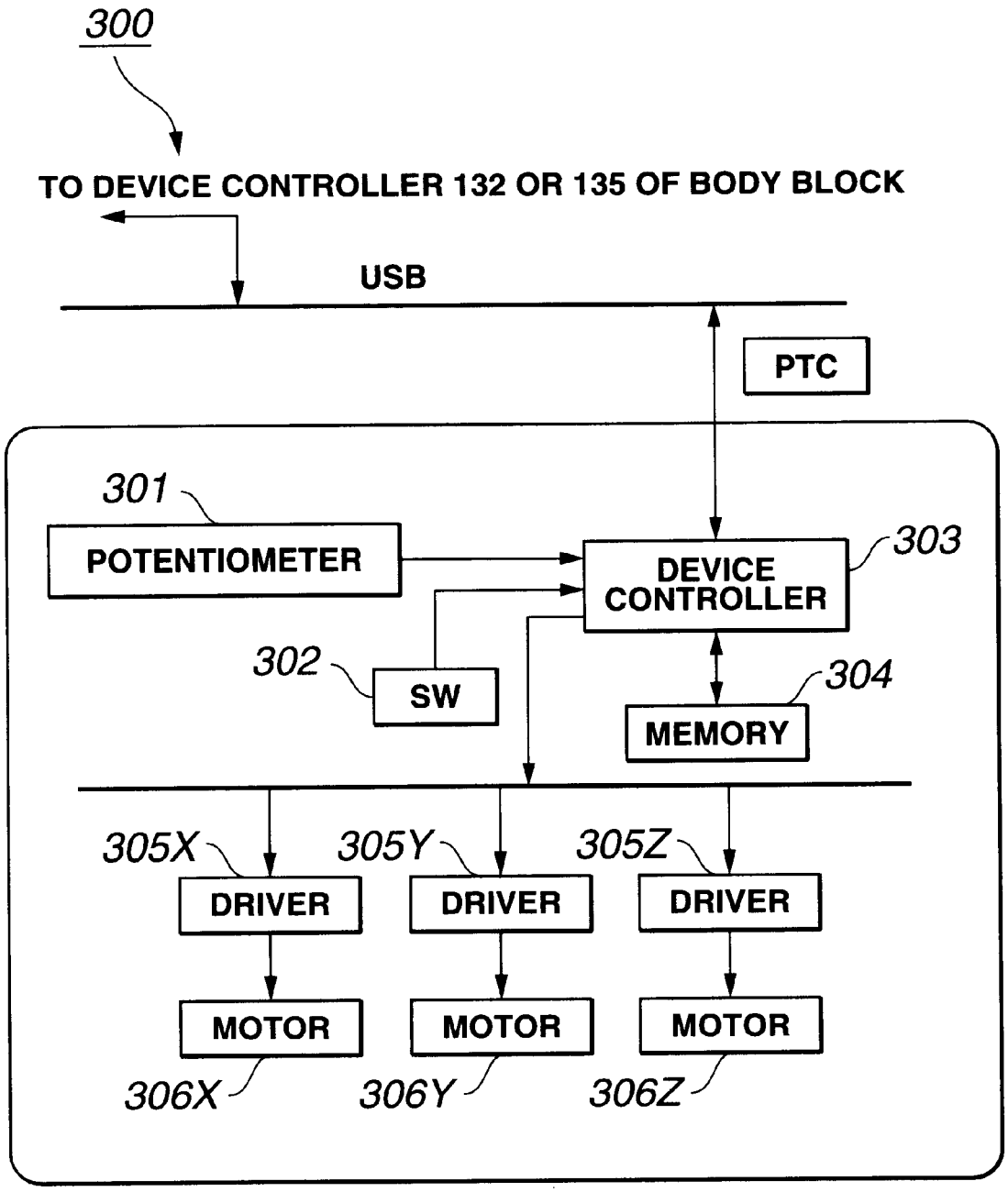
FIG. 4 is a block diagram of a foot block of the robot.

The foot block 300 includes, a potentiometer 301, a switch 302 to turn on/off the power of the foot block 300, an OPEN-R device controller 303 to control each circuit, a memory 304 to store initial state data which is to be used at the OPEN-R device controller 303 and temporarily store predetermined data, and motors 306 (306X, 306Y, 306Z) driven by drivers 305 (305X, 305Y, 305Z) under the control of the OPEN-R device controller 303, as shown in FIG. 4. Each foot block 300 corresponding to the right paw, left paw, right hind leg and left hind leg are of the above-described configuration.

Figure 5:
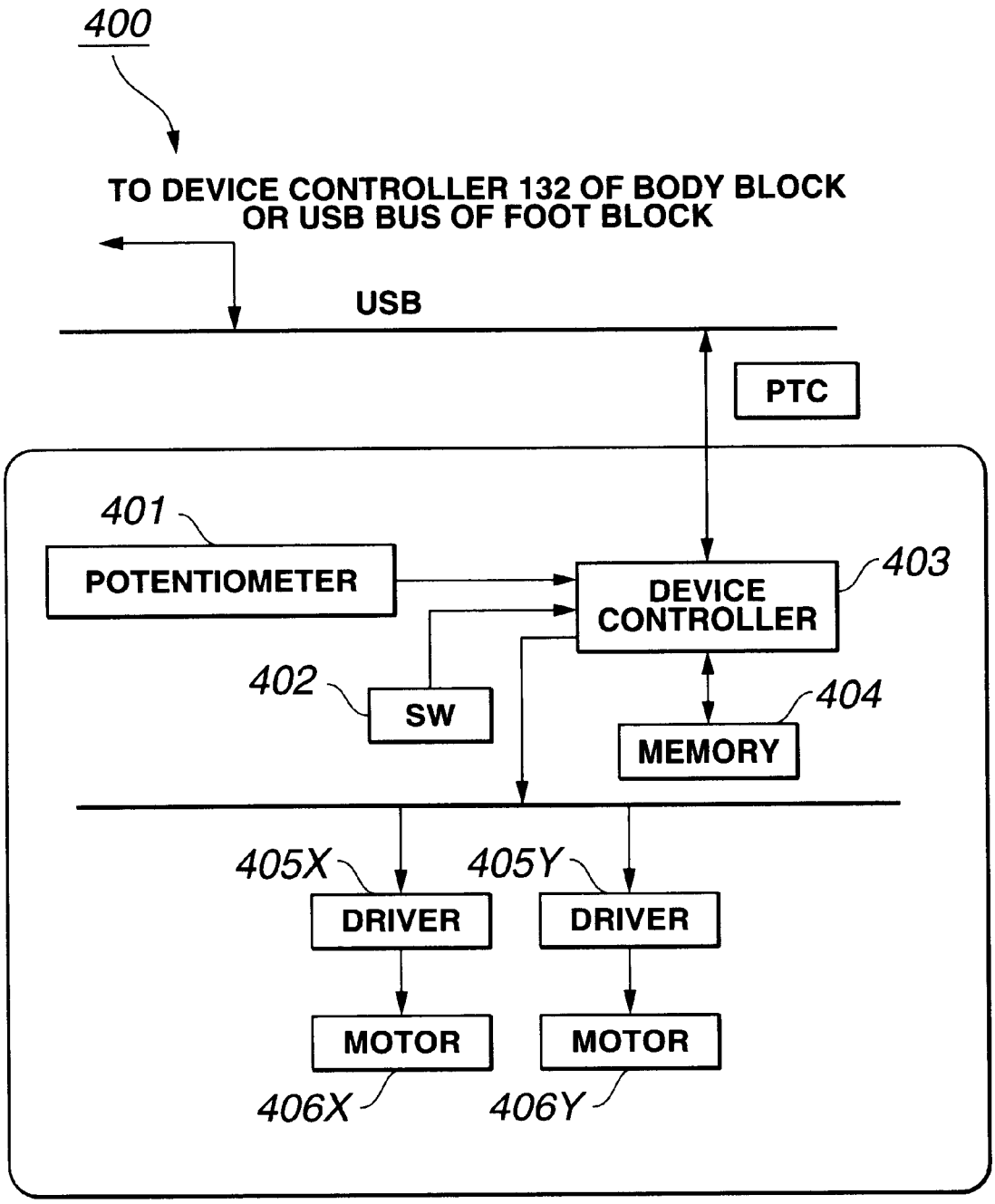
FIG. 5 is a block diagram of a tail block of the robot.

The tail block 400, whose configuration is substantially similar to that of the foot block 300, includes a potentiometer 401, a switch 402 to turn on/off the power of itself, an OPEN-R device controller 403 to control each circuit, a memory 404 to store initial state data which is to be used at the OPEN-R device controller 403 and temporarily store predetermined data, and motors 406 (406X, 406Y) driven by drivers 405 (405X, 405Y) under the control of the OPEN-R device controller 403, as shown in FIG. 5.

Figure 6:
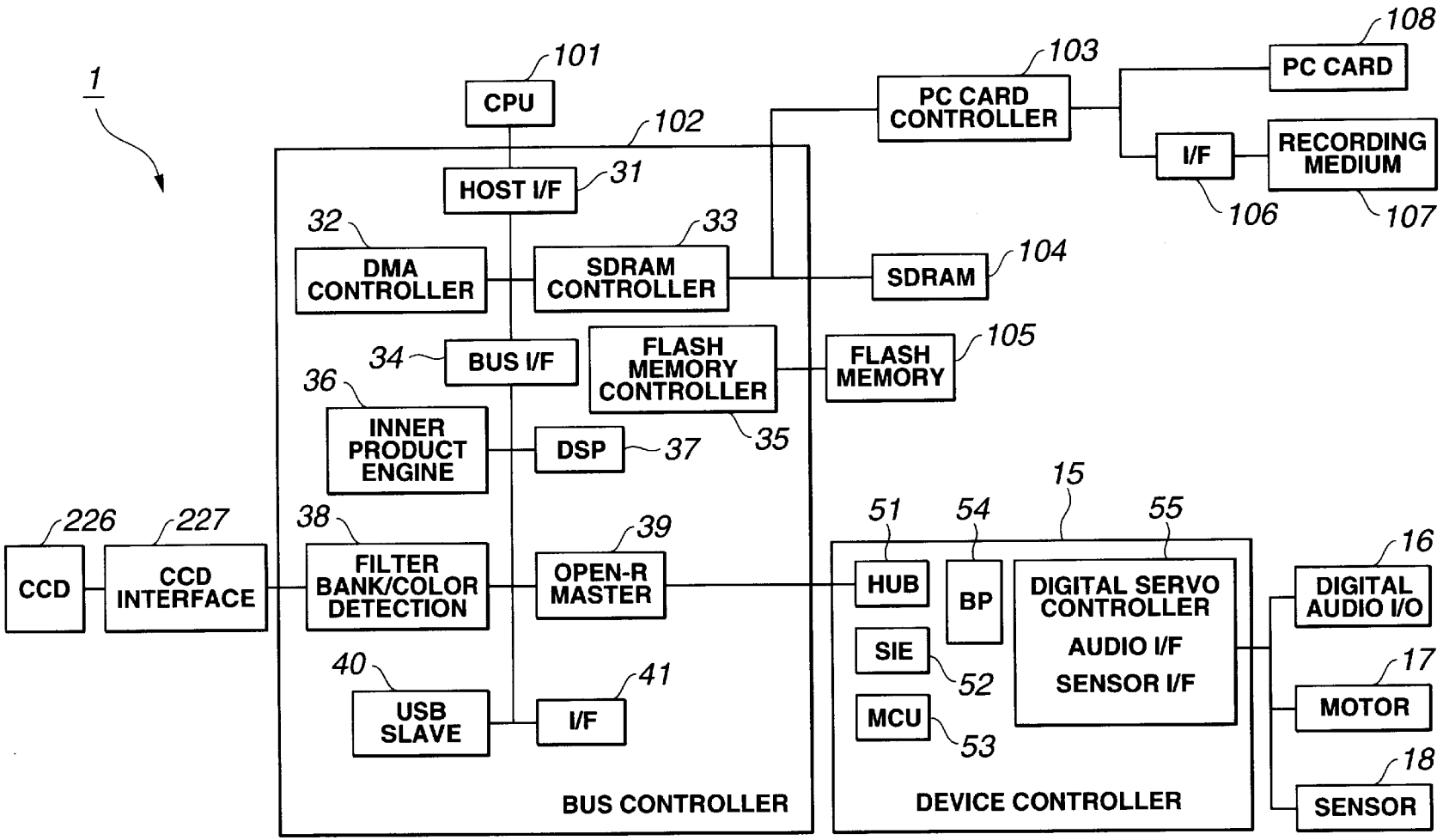
FIG. 6 shows a system configuration of the robot.

The configuration of the robot 1 is shown in FIG. 6. In FIG. 6, the elements or parts same as or similar to those in FIGS. 2 through 5 will be indicated with the same or similar reference numerals. In case a circuit shown in FIG. 6 is shown doubly or more in FIGS. 2 through 5, it will be indicated with any other reference numerals than those for the circuits in FIGS. 2 through 5.

In the robot 1, the CPU 101 controls the whole system.

The OPEN-R bus controller 102 works, under the control of the CPU 101, to control predetermined circuits, process data, and detect colors of image data supplied via the CCD image sensor 226 and CCD interface circuit 227.

The OPEN-R bus controller 102 outputs speech to outside via an OPEN-R device controller 15 and a digital audio I/O 16. The OPEN-R bus controller 102 controls the rotation of a motor 17 and recognizes detection result of each sensor 18 via the OPEN-R device controller 15.

The OPEN-R bus controller 102 writes predetermined processed image data etc. to the flash memory 105 and SDRAM 104, and reads those data from the flash memory 105. The OPEN-R bus controller 102 can store data into the memory of the robot 1 as well as into the removable PC card 108 via the PC card controller 103. Also, the OPEN-R bus controller 102 reads/writes data from/to the removable stick-shaped recording medium 107 via the PC card controller 103 and interface circuit 106.

The OPEN-R bus controller 102 includes a host interface 31 to connect itself to the CPU 101, a DMA controller 32, an SDRAM controller 33 to control reading/writing of data from/to the SDRAM 104, a bus interface 34, and a flash memory controller 35 to control reading/writing of data from/to the flash memory 19.

The OPEN-R bus controller 102 further includes an inner product engine 36, a digital signal processor (DSP) 37 to process data in a predetermined manner, a filter bank/color detection circuit 38 to perform filtering and color detection of the image data supplied from the CCD image sensor 226, an OPEN-R master circuit 39, a USB slave 40, and an interface 41. The OPEN-R device controller 15 includes a hub 51 which is to be used at the OPEN-R bus system, a serial interface engine (SIE) 52, a micro controller unit (MCU) 53, an end point (EP) 54, and a digital servo controller/audio interface/sensor interface 55.

Figure 7:
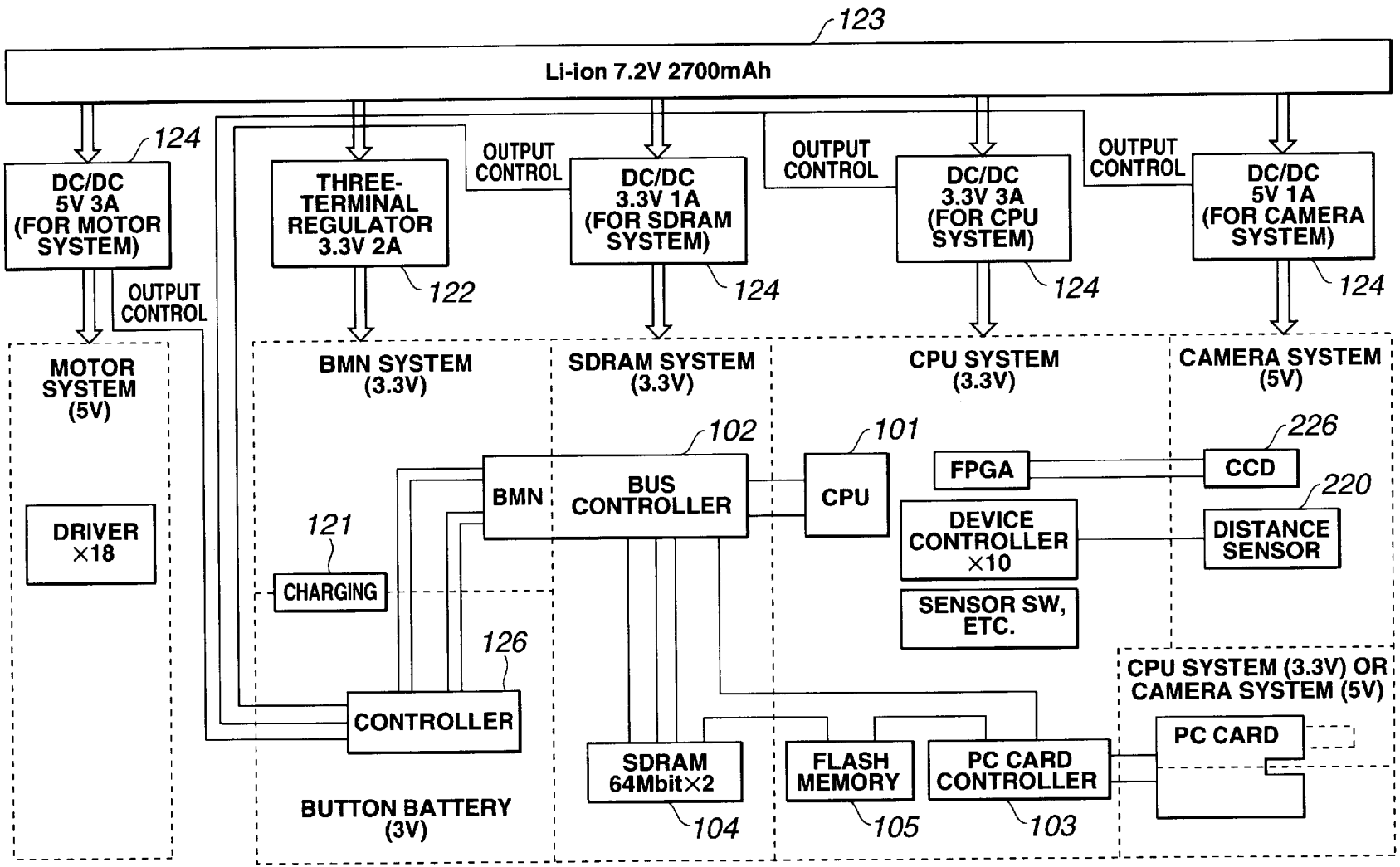
FIG. 7 is a schematic diagram of the power supply system for each circuit of the robot.

Next, the power supply system for each circuit will be explained with reference to FIG. 7.

There is provided a battery 123 which is a lithium ion battery to provide a power of 7.2V–2700 mA. The DC-DC converter 124 converts the voltage of the battery 123 to a predetermine value for supply to each circuit. For example, the DC-DC converter 124 supplies a power of 5V-1A to the distance sensor 220 and CCD image sensor 226, a power of 3.3V-3A to the CPU 101, PC card controller 103 and flash memory 105, a power of 5V-3A to each of the drivers 205, 224. The regulator 122 converts the voltage of the battery 123 to a voltage of 3.3V and applies the converted voltage to the controller 126 etc.

The robot 1 of the above-described configuration has each block connected to the body block 100, and the OPEN-R bus system is used to connect these blocks.

The OPEN-R system consists of an OPEN-R system core and OPEN-R bus devices. The OPEN-R bus device is a CPC (Configurable Physical Component) having a robot module connector called "OPEN-R connector", and is itself a robot module which can be connected to the OPEN-R system core by the OPEN-R connector. The OPEN-R system core has an OPEN-R bus host controller to control the OPEN-R bus, and can connect itself to a maximum of 127 OPEN-R bus devices. The OPEN-R system core corresponds to the OPEN-R master circuit 39 in the OPEN-R bus controller 102 shown in FIG. 6.

Figure 8:
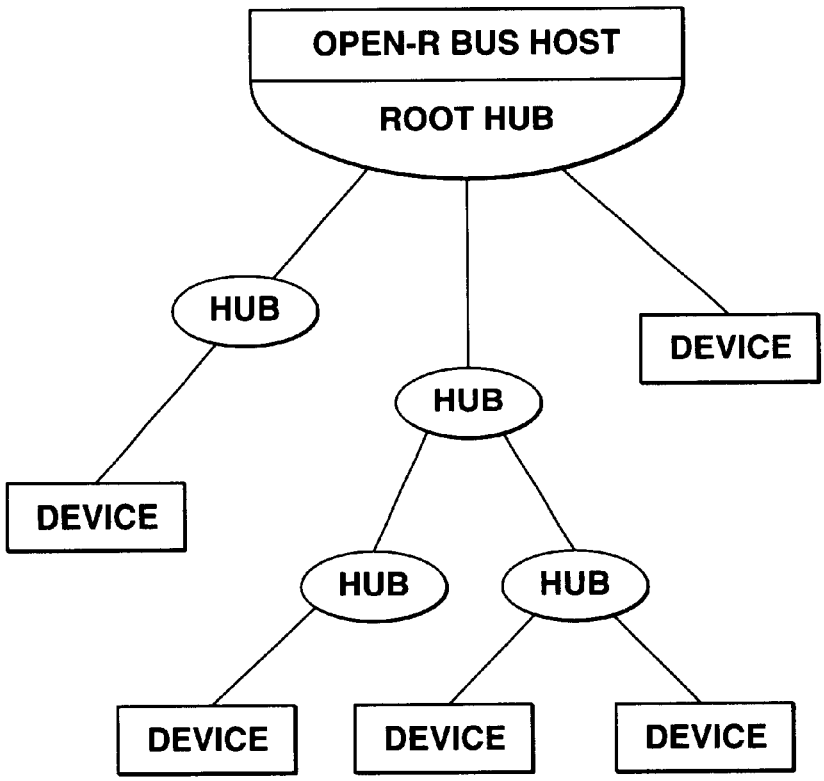
FIG. 8 outlines the OPEN-R bus system used in the robot.

The OPEN-R bus host controller and OPEN-R bus devices are physically connected to each other in a "hierarchical star topology", as shown in FIG. 8. A device called "hub" is disposed between the OPEN-R bus host controller and each of the OPEN-R bus devices. The "hub" corresponds to each of OPEN-R device controllers in the body block 100, head block 200, foot blocks 300 and tail block 400. The OPEN-R bus host controller is connected to each hub with an interconnecting interface and the hub is connected to each OPEN-R bus device with an interconnecting interface. Of the interconnecting interfaces, a one going downward from the OPEN-R bus host controller or hub is called "downstream port", while a one going upward from the OPEN-R bus device is called "upstream port". In the OPEN-R bus system, any loop connection is prohibited.

Figure 9:
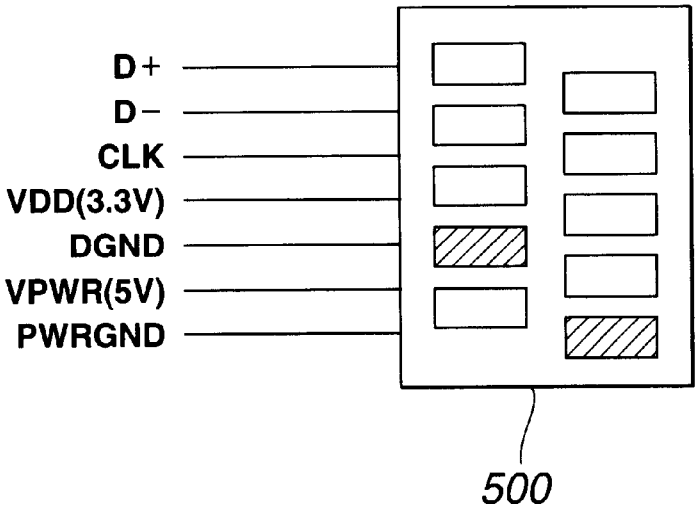
FIG. 9 is a schematic diagram of an OPEN-R connector to connect each block in the OPEN-R bus system.
Figure 10:
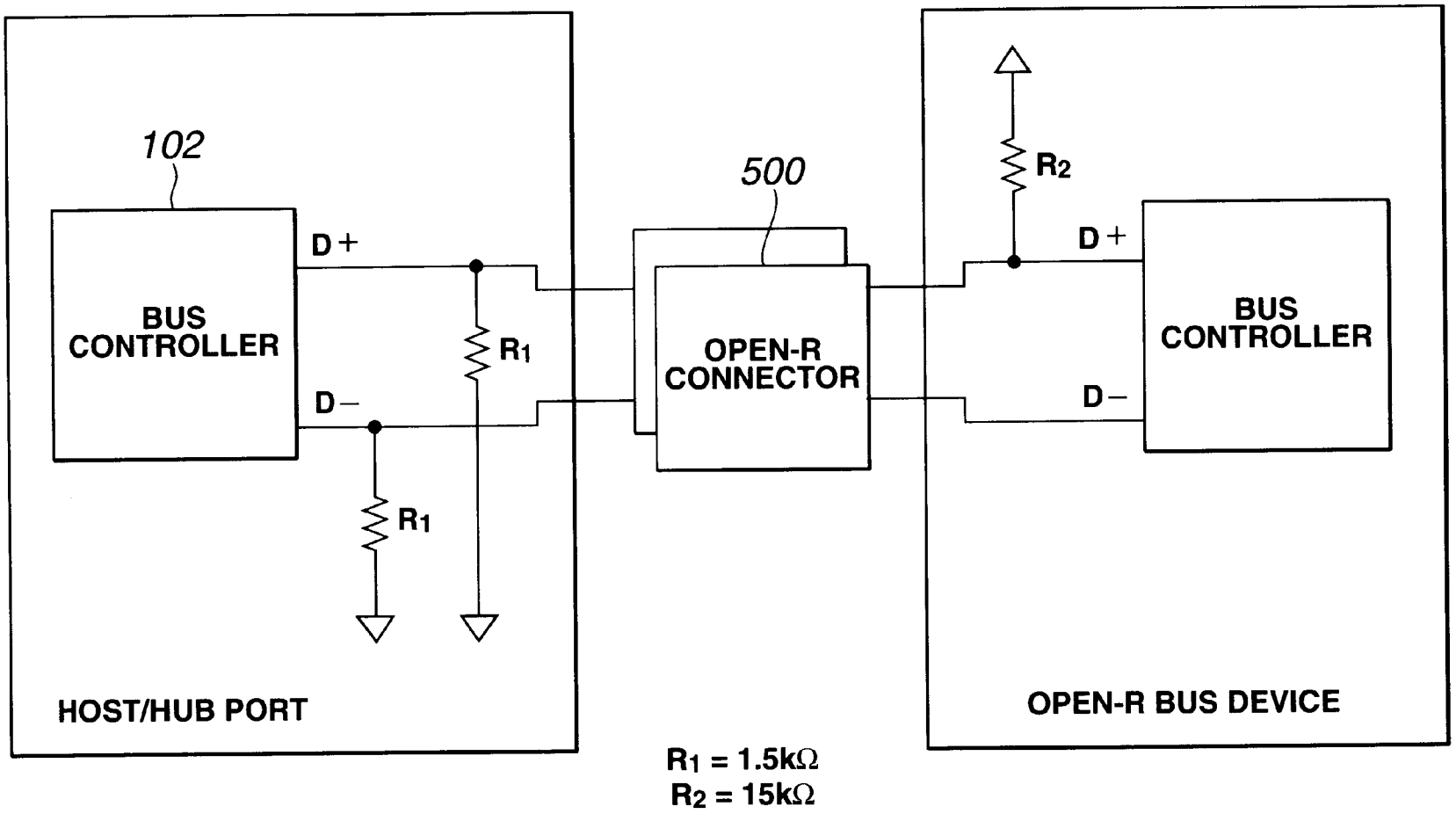
FIG. 10 shows a data signal termination of the OPEN-R bus system.

The OPEN-R connector 500 has ten pins, as shown in FIG. 9. The OPEN-R bus transmits data consisting of differential signals D+ and D− at a rate of 12 Mbps conforming to the full speed in the Universal Serial Bus Specification 1.0.

The D+ and D− lines are pulled down across a 1.5 kΩ resistor at the upper side (downstream port of the host or hub). The D+ line of the device side is pulled up by a 15 kΩ resistor.

The clock signal CLK is of 12 MHz, and is occasionally used as a clock source of external devices. The OPEN-R bus is supplied with powers VDD (3V) and VPWR (5V). The power lines are also provided with ground lines DGND and PWRGND. Of the ten pins of the OPEN-R connector 500, the DGND and PWRGND pins are formed longer than the other pins.

The hot swapping of the OPEN-R connector 500 will be explained concerning the replacement of the tail block 400 of the robot 1 as an example.

When the main switch 127 of the body block 100 is turned on, the DC-DC converter 124 supplies a power of a predetermined value to each circuit. The CPU 101 400 initializes itself at first, and then initializes the tail block 400 after checking the connection state of each block. For example, the OPEN-R device controller 403 of the tail block 400 reads the initial state data from the memory 404 and drives the motors 406 by the drivers 405 in accordance with the data.

The CPU 101 checks the state of the tail block 400 periodically, and is programmed so that, when the tail block 400 is disconnected, it shifts to an operation mode in which it will control each block without the tail block 400.

After the OPEN-R connector 500 connecting the body block 100 and tail block 400 to each other is disconnected, pins of the ground lines DGND and PWRGND remain connected. So, even if the power is being supplied, a trouble caused by a short-circuit can be avoided. Then, after recognizing that the tail block 400 is not connected, the CPU 101 can normally shifts to the operation mode which should be without the tail block 400.

On the other hand, when the OPEN-R connector 500 is connected, pins of the ground lines DGND and PWRGND will be connected earliest. Thus, even if the power is being supplied, a trouble caused by a short-circuit can be avoided.

After recognizing that the tail block 400 is connected, the CPU 101 initializes the tail block 400, reads the initial state data from the memory 404 and normally shifts to an operation mode in which it will control each block with the tail block 400 connected. At this time, since the CPU 101 does not initialize the head block 200 and foot blocks 300 which are not replaced, time required to initialize the tail block 400 will be shorter than required to energize the whole system. The CPU 101 will not lose data stored in the body block 100 and head block 200 and which have been acquired by learning before the tail block 400 is replaced. Thus, the data can be effectively utilized also after replacing the tail block 400.

Furthermore, pins of the ground lines DGND and PWRGND as well as the power lines VDD and VPWR can be formed longer. When the OPEN-R connector 500 is disconnected, the VDD, DGND, VPWR and PWRGND pins will be disconnected after the CLK, D+ and D− pins are disconnected. Thus, even if the power is being supplied, a trouble caused by a short-circuit can be avoided. When the OPEN-R connector 500 is connected, the CLK, D+ and D− pins will be connected after the VDD, DGND, VPWR and PWRGND pins are connected. Thus, even if the power is being supplied, a trouble caused by a short-circuit can be avoided.

It should be apparent that numerous modifications could be made to the present invention by those skilled in the art without departing from the basic concept and scope of the present invention.

For example, instead of forming the DGND and PWRGND pins longer than the other pins, electrically connecting the ground lines DGND and PWRGND by another method can also attain the object of the present invention as long as these ground lines are disconnected later than the other lines when dismounting the tail block 400 from the body block 100.

Similarly, instead of forming the DGND and PWRGND pins longer than the other pins, electrically connecting the ground lines DGND and PWRGND by another method can also attain the object of the present invention as long as these ground lines are connected earlier than the other lines when reinstalling the tail block 400 to the body block 100.

Embodiments based on the OPEN-R specification have been described in the foregoing. However, it should be apparent that the present invention can be applied to robots based on any other specification as well as those based on the OPEN-R specification.

INDUSTRIAL APPLICABILITY

The robot according to the present invention comprises one or more driving units and a main body for controlling the driving units. Each of the driving units is connected to the main body by a connector having groung, power and data lines. The ground line will be disconnected later than the power and data lines when any of the driving units is dismounted from the main body and it will be connected earlier than the power and data lines when the driving unit is mounted in place again. Thus, a trouble caused by a short-circuit can be avoided and driving units of such as paws, hind legs and head can be replaced without the power off.

What is claimed is:

1. A robot apparatus comprising:

one or more driving units;

a main body to which the driving units are mounted and including means for controlling the driving units; and connection means for connecting the driving unit to the main and including respective connectors each having connecting elements corresponding to ground, power and data lines configured in such a manner that the ground line is disconnected later than the power and data lines when the respective driving unit is dismounted from the main body and said ground line is connected earlier than the power and data lines when the driving unit is mounted on the main body, wherein said connection means configuration allows a power source, located in the main body and for powering said driving unit via said connectors, to remain turned on during the time that the driving unit is being either mounted on or dismounted from said main body;

while minimizing the chance of a short-circuit or lost data, and the need to reinitialize the robot.

2. The robot apparatus as set forth in claim 1, wherein the connector has formed a ground line terminal longer than power and data line terminals thereof.

3. The robot apparatus as set forth in claim 2, wherein the power line terminal of the connector is formed longer than the data line terminal thereof.

* * * * *